US007418223B2

(12) United States Patent
Suzuki

(10) Patent No.: US 7,418,223 B2
(45) Date of Patent: Aug. 26, 2008

(54) IMAGE FORMING APPARATUS

(75) Inventor: Shinya Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 236 days.

(21) Appl. No.: 11/509,026

(22) Filed: Aug. 24, 2006

(65) Prior Publication Data

US 2007/0048025 A1 Mar. 1, 2007

(30) Foreign Application Priority Data

Aug. 30, 2005 (JP) ..... 2005-250260

(51) Int. Cl.
*G03G 15/30* (2006.01)
*G03G 15/08* (2006.01)

(52) U.S. Cl. ..... 399/149; 399/257

(58) Field of Classification Search ..... 399/38, 399/53, 99, 148, 149, 257, 343, 358
See application file for complete search history.

(56) References Cited

U.S. PATENT DOCUMENTS 6,314,251 B1 * 11/2001 Gomi et al. ..... 399/38
6,952,546 B2 10/2005 Yoshikawa ..... 399/129
2006/0029405 A1 * 2/2006 Tanaka et al. ..... 399/27

FOREIGN PATENT DOCUMENTS

JP 2004-21178 1/2004
JP 2004-117960 4/2004

* cited by examiner

*Primary Examiner*—Hoang Ngo
(74) *Attorney, Agent, or Firm*—Fitzpatrick, Cella, Harper & Scinto

(57) ABSTRACT

An image forming apparatus having a plurality of image forming stations each provided with an image bearing member, a developing device for collecting any untransferred toner on the image bearing member and at the same time, developing an electrostatic image with a toner, and a transfer device for transferring the toner image on the image bearing member to a transfer material, wherein when in a first station and a second station downstream thereof with respect to the movement direction of the transfer material, of the plurality of image forming stations, a toner discharging operation of discharging the toner from each developing device is performed during a non-image forming operation, the toner discharging amount in the second station is controlled so as to be greater than the toner discharging amount in the first station.

7 Claims, 9 Drawing Sheets

IMAGE FORMING APPARATUS

BACKGROUND OF THE INVENTION

1. Field of the Invention

The invention relates to an image forming apparatus using an electrophotographic printing method, an electrostatic recording method or the like, and particularly to an image forming apparatus which collects a toner residual on an image bearing member after the transferring step by developing means and reuses it.

2. Related Background Art

An image forming apparatus such as a copying machine, a printer or a facsimile apparatus using the electrophotographic printing method generally has a cylindrical electrophotographic photosensitive member (photosensitive member) as an image bearing member. Also, the image forming apparatus has a charging device (charging step) for uniformly charging the photosensitive member to a predetermined polarity and potential, and an exposing device (exposing step) as information writing means for forming an electrostatic image on the charged photosensitive member. Also, the image forming apparatus has a developing device (developing step) for visualizing the electrostatic image formed on the photosensitive member as a developer image (toner image) with a toner as a developer, and a transfer device (transferring step) for transferring the toner image from the surface of the photosensitive member to a transfer material. Also, the image forming apparatus has a fixing device (fixing step) for finally fixing the toner image transferred to the transfer material such as recording paper. Further, generally, the image forming apparatus has a cleaning device (cleaning step) for removing any toner (residual developer or untransferred toner) more or less residual on the photosensitive member after the transferring step and cleaning the surface of the photosensitive member. As described above, in the image forming apparatus of the electrophotographic printing type, the photosensitive member is repetitively subjected to an electrophotographic process (the charging step, the exposing step, the developing step, the transferring step and the cleaning step) and is used for image formation.

The untransferred toner is removed from the surface of the photosensitive member by the cleaning device, is collected into the cleaning device and becomes a waste toner. However, from such viewpoints as the preservation of the environment and the effective utilization of resources, it is desirable that such a waste toner does not come out.

From such viewpoints, there has been proposed an image forming apparatus, which returns the untransferred toner, collected in the cleaning device to the developing device and reuses it.

Also, there has been proposed an image forming apparatus of a "cleanerless type" in which the cleaning device is disused and the untransferred toner is removed and collected from on the photosensitive member by "cleaning simultaneous with developing" in the developing device, and is reused.

The cleaning simultaneous with developing collects the untransferred toner on the photosensitive member after the transferring step into the developing device during the developing step after the next step. That is, the photosensitive member to which the untransferred toner adheres is continuedly charged and exposed to thereby form an electrostatic image. Then, during the developing step for this electrostatic image, of the untransferred toner residual on the surface of the photosensitive member, the untransferred toner present on a portion (non-image portion), which should not be developed, is removed and collected into the developing device by fog removal bias. The fog removal bias is the potential difference (fog removal potential difference Vback) between a DC voltage applied to the developing device and the surface potential of the photosensitive member.

Here, the untransferred toner is not constant in the charging amount thereof and therefore, is difficult to intactly collect into the developing device. Therefore, there is a method of applying a bias to a charge assisting member or the like provided downstream of a transfer portion (transfer position) with respect to the rotation direction of the photosensitive member, to thereby uniformize the charging amount of the untransferred toner to a desired charging amount, and collect the untransferred toner by the developing device (Japanese Patent Application Laid-open No. 2004-117960).

According to such a cleanerless type, the untransferred toner is collected by the developing device and is reused for the development of the electrostatic image after the next step. Therefore, the waste toner can be eliminated, and cumbersomeness can be reduced during maintenance. Also, a cleaning member and a waste toner conveying mechanism are unnecessary, and this is also advantageous to the downsizing of the image forming apparatus.

There has also been proposed an image forming apparatus provided with a plurality of image forming portions of such a cleanerless type as described above (Japanese Patent Application Laid-open No. 2004-021178). That is, a plurality of image forming portions each adopting the cleanerless type are disposed along the movement direction (progress direction) of a transfer material. Yellow, magenta, cyan and black toner images are formed by the respective image forming portions, and are successively superposed and transferred to thereby obtain a full-color image formed article (a copy or a print).

However, it has been found that the image forming apparatus provided with a plurality of image forming portions of such a cleanerless type as described above along the movement direction of the transfer material suffers from the following problem.

In the developing device, not only the untransferred toner produced in each image forming portion, but also a toner (re-transferred toner) resulting from the re-transfer of part of a toner image formed by an upstream image forming portion with respect to the movement direction of the transfer material is collected. The re-transfer is the phenomenon that part of the toner image transferred to the transfer material in the upstream image forming portion with respect to the movement direction of the transfer material adheres onto the photosensitive member of a downstream image forming portion in the transferring portion of the downstream image forming portion. In the more downstream image forming portion with respect to the movement direction of the transfer material, the greater becomes the number of upstream image forming portions. Therefore, the more downstream image forming portion is greater in the amount of re-transferred toner, and becomes greater also in the amount of toner collected by the developing device.

Here, the untransferred toner and the re-transferred toner are toners, which could not be borne on the transfer material even if a transfer electric field was applied in the transferring portion of the image forming portion. Therefore, it is often the case that the charging charges of the untransferred toner and the re-transferred toner have a polarity opposite to a regular charging polarity or do not have a polarity. Also, it is often the case that the untransferred toner and the re-transferred toner are different-shaped toners as their toner shape or differ in their toner particle diameter from the mean particle diameter. Further, the re-transferred toner is part of a toner image comprising a toner of a discrete color formed in the upstream image forming portion and therefore, sometimes differs also in the nature of the toner.

The untransferred toner and the re-transferred toner, as described above, are returned to a proper charging amount by the charge assisting member provided downstream of the transferring portion with respect to the rotation direction of the photosensitive member and are collected by the developing device. However, the more downstream image forming portion is greater in the amount of re-transferred toner and therefore, the charge assisting member is liable to be contaminated by the toner and an extraneous additive or the like accumulating thereon. Therefore, the more downstream image forming portion becomes more insufficient in the control of the charging amounts of the untransferred toner and the re-transferred toner.

Thereby, it becomes liable to happen that the toner having passed the charge assisting member is not collected by the developing device or the developer in the developing device is increased in the amount of toner differing from the regular charging polarity. Therefore, a faulty image such as "fog" in which the toner adheres to a white background portion becomes liable to occur.

Also, the re-transferred toner is part of a toner image comprising a toner of a discrete color formed in the upstream image forming portion. Therefore, the mixing of colors occurs in the developing device into which the re-transferred toner has been collected, and it sometimes becomes impossible to reproduce an image of a proper color.

SUMMARY OF THE INVENTION

Accordingly, it is the object of the present invention to provide an image forming apparatus, which can reduce an inconvenience caused by a toner from a more upstream image forming portion with respect to the movement direction of a transfer material being collected by the developing means of a more downstream image forming portion.

An image forming apparatus for achieving the above object has a plurality of image forming stations each provided with an image bearing member on which an electrostatic image is formed, a developing device for collecting any untransferred toner on the image bearing member and at the same time, developing the electrostatic image with a toner, and a transfer device for transferring the toner image on the image bearing member to a transfer material, and disposed along the movement direction of the transfer material; and control means for controlling, when during a non-image operation, a toner discharging operation of discharging the toner from each developing device is performed in a first station and a second station downstream of the first station with respect to the movement direction of the transfer material, of the plurality of image forming stations, the toner discharging amount in the second station so as to be greater than the toner discharging amount in the first station.

DESCRIPTION OF THE PREFERRED EMBODIMENTS

Image forming apparatuses according to the present invention will hereinafter be described in detail with reference to the drawings.

Embodiment 1

(General Construction and Operation of the Image Forming Apparatus)

Figure 1:
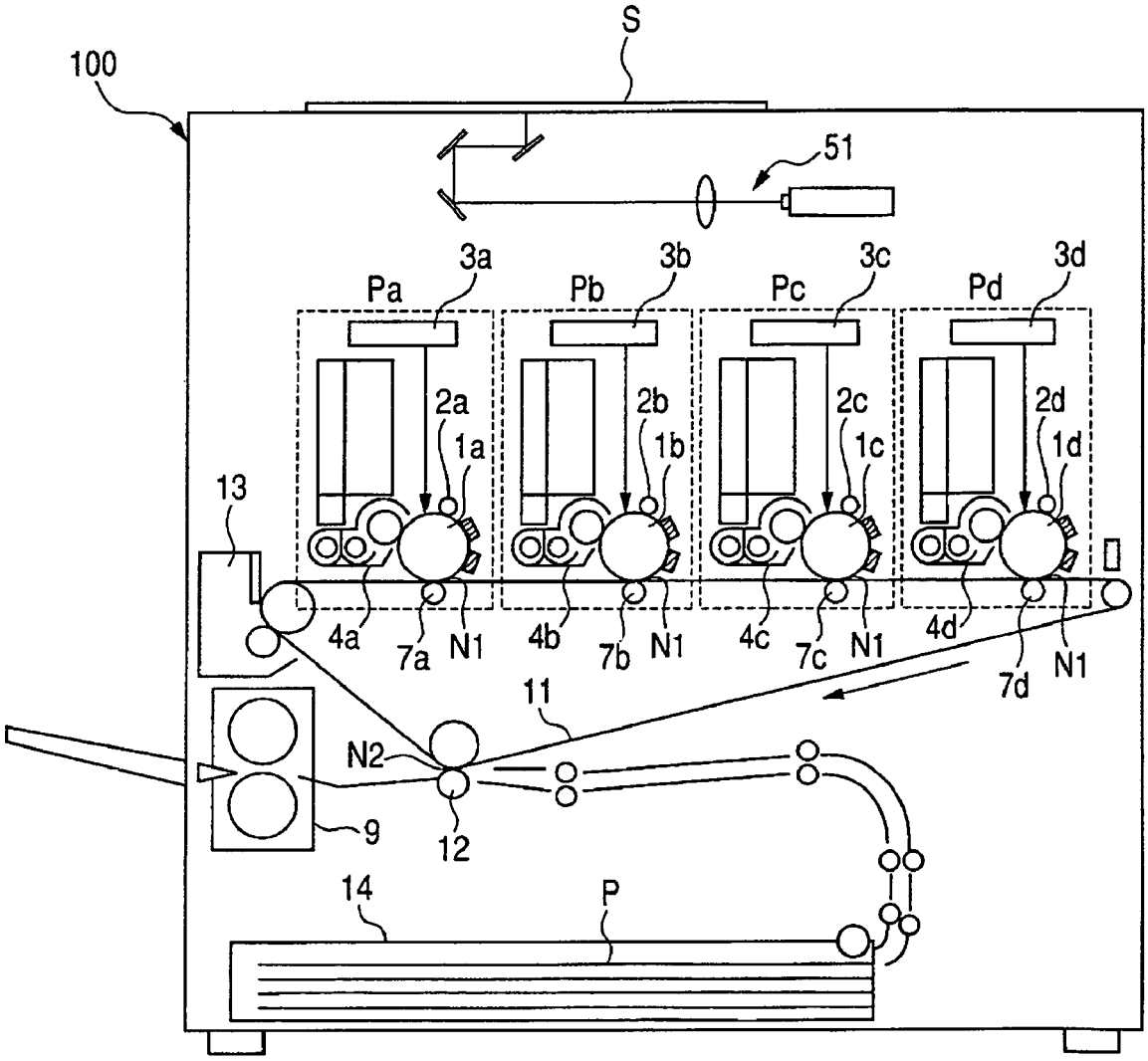
FIG. 1 is a schematic cross-sectional view of an embodiment of an image forming apparatus according to the present invention.
Figure 2:
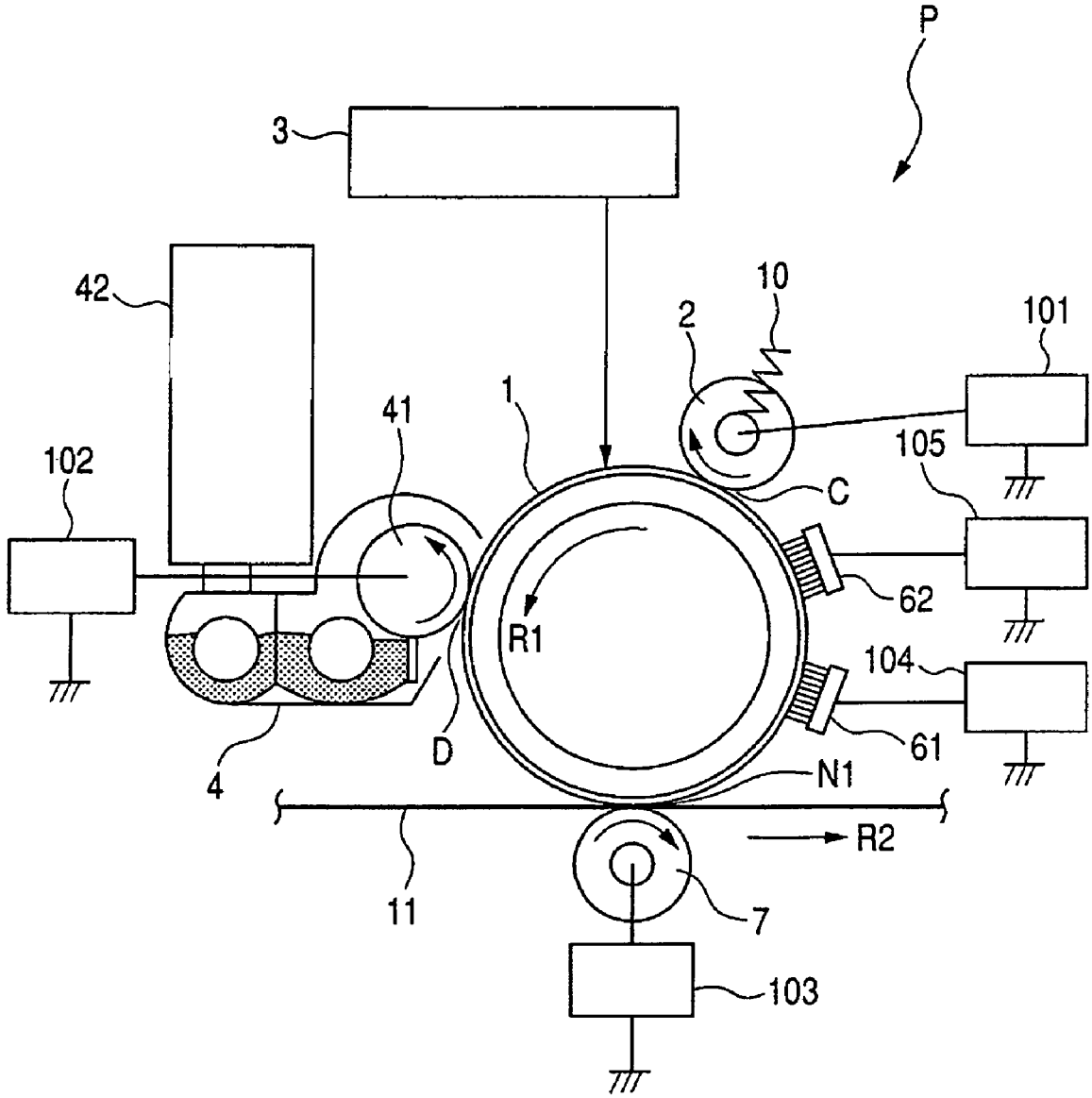
FIG. 2 is a schematic cross-sectional view of an image forming portion in the image forming apparatus of FIG. 1.

Description will first be made of the general construction and operation of an image forming apparatus according to the present embodiment. FIG. 1 shows a schematic cross sectional view of the image forming apparatus 100 according to the present embodiment. The image forming apparatus 100 according to the present embodiment is an image forming apparatus of a so-called tandem type having a plurality of image forming portions along the movement direction of a transfer material. FIG. 2 shows a schematic cross-sectional view of each image forming portion.

The image forming apparatus 100 according to the present embodiment adopts an intermediate transferring method, a contact charging method, a dual component contact developing method and a cleanerless method. The image forming apparatus 100 can form a full-color image on the transfer material (such as, for example, recording paper, an OHP sheet or cloth) P. An image information signal is transmitted from an original reading apparatus (reader portion) 51 provided in an image forming apparatus main body, or a host computer or a digital camera communicably connected to the image forming apparatus main body.

In the image forming apparatus 100, first, second, third and fourth image forming portions (image forming stations) Pa, Pb, Pc and Pd are juxtaposed in series in an image feeding direction as a plurality of image forming portions. In the present embodiment, the constructions and operations of the image forming portions Pa, Pb, Pc and Pd are substantially the same except the colors of toners used, and the toner discharging operation, which will be described later. Accordingly, in cases where distinctions are not particularly required, description will be made generically while omitting the suffixes a, b, c and d given the reference character to represent the fact of being elements provided for the respective colors.

In the image forming portion P, there is provided a cylindrical photosensitive member, i.e., a photosensitive drum 1, which is an image bearing member. Around the photosensitive drum 1, there are provided a charging device 2 as charging means, an exposing device 3 as exposing means (information writing means), and a developing device 4 as developing means. Also, around the photosensitive drum 1, there are provided an upstream charge assisting device 61 and a downstream charge assisting device 62 as charge assisting means, and a primary transfer device 7 as primary transferring means. An endless intermediate transfer belt 11 as an intermediate transfer member which is a transfer member is disposed so as to pass between the photosensitive drums 1*a*, 1*b*, 1*c*, 1*d* of the image forming portions Pa, Pb, Pc, Pd and the primary transfer devices 7*a*, 7*b*, 7*c*, 7*d*. The primary transfer device 7 contacts with the inner periphery of the intermediate transfer belt 11 to thereby bring the intermediate transfer belt 11 into pressure contact with the photosensitive drum 1, whereby a primary transferring portion (primary transfer nip) N1 is formed. The photosensitive drum 1 is supported for rotation in the direction indicated by the arrow R1 (counterclockwise direction) in FIG. 2. Also, the intermediate transfer belt 11 is supported for round movement (rotation) in the direction indicated by the arrow R2 (clockwise direction) in FIG. 2.

The surface of the photosensitive drum 1 being rotated is uniformly charged by the charging device 2. Light conforming to the image information signal is applied from the exposing device 3 to the charged surface of the photosensitive drum 1. In the present embodiment, the exposing device 3 has a light source device and a polygon mirror or the like installed above the photosensitive drum 1 as viewed in FIG. 2. The exposing device 3 scans a laser beam emitted from the light source device, by rotating the polygon mirror, and deflects the beam of the scanning light by a plurality of reflecting mirrors. Then, the exposing device 3 condenses this light on the generatrix of the photosensitive drum 1 by an fθ lens and exposes the photosensitive drum to the light. Thereby, an electrostatic image (latent image) conforming to the image signal is formed on the photosensitive drum 1.

In the present embodiment, the first, second, third and fourth image forming portions Pa, Pb, Pc and Pd form yellow, magenta, cyan and black images, respectively. Here, in the present embodiment, the developing devices 4*a*, 4*b*, 4*c* and 4*d* are filled with predetermined amounts of dual-component developers each consisting of a nonmagnetic toner (toner) and a magnetic carrier (carrier) mixed together at a predetermined mixing ratio. The toners filling the developing devices 4 of the first, second, third and fourth image forming portions are yellow, magenta, cyan and black toners, respectively.

The electrostatic image on the photosensitive drum 1 is supplied with the toner by the developing device 4, and is developed as a toner image. The toner image formed on the photosensitive drum 1 is then primary-transferred onto the intermediate transfer belt 11.

During the formation of a full-color image, the charging, exposing, developing and primary transferring steps as described above are executed in the first, second, third and fourth image forming portions Pa, Pb, Pc and Pd. Then, the toner images of the respective colors are successively superposed and transferred onto the intermediate transfer belt 11 in the primary transferring portions N1 of the image forming portions Pa, Pb, Pc and Pd.

On the other hand, in synchronism with the toner image on the intermediate transfer belt 11, a transfer material P contained in a transfer material cassette 14 is conveyed to a secondary transferring portion (secondary transfer nip) N2 which is the contact portion between the intermediate transfer belt 11 and a secondary transfer device 12 as secondary transferring means.

The toner image on the intermediate transfer belt 11 is secondary-transferred to the transfer material P in the secondary transferring portion N2. Then, the transfer material P is heated and pressurized in a fixing portion 9, whereby the toner image is fixed thereon. Thereafter, the transfer material P is discharged out of the apparatus as a recorded image.

Now, at least part of primary untransferred toners residual on the photosensitive drum 1 after the primary transferring step, as will be described later in detail, has its charging amount controlled by the upstream charge assisting device 61 and the downstream charge assisting device 62, and thereafter is collected by the developing device 4.

On the other hand, a belt cleaning device 13 is provided downstream of the secondary transferring portion N2 (upstream of the primary transferring portion N1 of the first image forming portion Pa) with respect to the movement direction of the intermediate transfer belt 11. The belt cleaning device 13 collects fog toners and secondary untransferred toners adhering to the surface of the intermediate transfer belt 11. In the present embodiment, the belt cleaning device 13 has a cleaning blade as a cleaning member formed of an elastic material and normally abutting against the intermediate transfer belt. The adhering substances on the intermediate transfer belt 11 are scraped off by the cleaning blade.

(Cleanerless Type)

The image forming operation by the cleanerless type in the present embodiment will now be described in greater detail.

The image forming apparatus 100 according to the present embodiment effects image formation at a process speed (corresponding to the surface movement speed of the photosensitive drum 1) of 130 mm/sec.

At first, a high voltage is applied to the charging device 2, whereby the surface of the photosensitive drum 1 is uniformly charged. In the present embodiment, as the charging device 2, use is made of a charging roller which is a contact charging member contacting with the photosensitive drum 1. However, the contact charging member is not restricted thereto, but a contact charging member of other shape and material such as a fur brush or felt is also usable. It is also possible to obtain one having more appropriate elasticity, electrical conductivity, surface property and durability by a combination of various materials.

The charging roller 2 has the opposite end portions of its mandrel rotatably held by bearing members (not shown) and also, is biased toward the photosensitive drum 1 by a pressure spring 10 and is brought into pressure contact with the surface of the photosensitive drum 1 with a predetermined pressure force. Thereby, the charging roller 2 is driven to rotate by the rotation of the photosensitive drum 1. The contact portion between the photosensitive drum 1 and the charging roller 2 is a charging portion C. A charging bias voltage of a predetermined condition is applied to the mandrel of the charging roller 2 by a charging bias voltage source (high voltage source) as charging bias output means. Thereby, the surface of the photosensitive drum 1 being rotated is contact-charged to a predetermined polarity and potential.

In the present embodiment, the charging bias voltage to the charging roller 2 is a vibration voltage comprising a DC voltage (Vdc) and an AC voltage (Vac) superimposed one upon the other. More specifically, it is a vibration voltage comprising a DC voltage of −500V and an AC voltage of a sine wave of a frequency 1.3 kHz and a peak-to-peak voltage Vpp=1.5 kV superimposed one upon the other. Thereby, the surface of the photosensitive drum 1 is uniformly charged to −500V (dark potential Vd) which is substantially the same as the DC voltage applied to the charging roller 2.

Next, an electrostatic image is formed on the charged surface of the photosensitive drum 1 by the exposing device 3. In the present embodiment, the exposing device 3 is a laser beam scanner using a semiconductor laser.

Next, in accordance with the electrostatic image on the photosensitive drum 1, the toner is supplied to the photosensitive drum 1 by the developing device 4, whereby a toner image is formed on the photosensitive drum 1. In the present embodiment, the developing device 4 is a developing device adopting a dual-component contact developing method. That is, the developing device 4 effects development while bringing a magnetic brush by a dual-component developer provided with a nonmagnetic toner (toner) and a magnetic carrier (carrier) into contact with the photosensitive drum 1.

The developing device 4 is provided with a nonmagnetic developing sleeve 41 as a developer carrying member. The developing sleeve 41 has a portion of its outer peripheral surface exposed to the outside of the developing device 4. The developing sleeve 41 is disposed in opposed relationship with the photosensitive drum 1 with its closest distance (S-D gap) to the photosensitive drum 1 kept at 350 μm. The opposed portion between this photosensitive drum 1 and the developing sleeve 41 is a developing portion D. Also, the developing sleeve 41 is rotatively driven so that the surface thereof may move in a direction opposite to the surface movement direction of the photosensitive drum 1 in the developing portion D.

In the present embodiment, the magnetic carrier of the dual-component developer has volume resistivity of about $10^{13}$ Ω·cm and a volume mean particle diameter of about 40 μm. A range of 0.5-350 μm is logarithmically divided into 32 and measured by the use of a laser diffraction type particle size distribution measuring apparatus. HEROS (produced by Nippon Denshi Co., Ltd.), and a volume 50% median diameter is regarded as the volume mean particle diameter. Also, in the present embodiment, the nonmagnetic toner consists of resin comprising chiefly polyester, and a colorant, a charge control agent or the like dispersed therein to thereby provide a powder material having a volume mean particle diameter of the order of 8 μm. Also, in the present embodiment, the nonmagnetic toner is frictionally charged to the negative polarity by rubbing against the magnetic carrier. That is, in the present embodiment, the regular charging polarity of the toner is the negative polarity.

A predetermined developing bias is applied from a developing bias voltage source (high voltage source) 102 as developing bias output means to the developing sleeve 41. In the present embodiment, the developing bias voltage is a vibration voltage comprising a DC voltage (Vdc) and an AC voltage (Vac) superimposed one upon the other. More specifically, it is a vibration voltage comprising a DC voltage of −350V and an AC voltage of a rectangular wave of a frequency 8.0 kHz and a peak-to-peak voltage Vpp=1.8 kV superimposed one upon the other. The electrostatic image is reversal-developed by this developing bias and the electric field of the electrostatic image formed on the surface of the photosensitive drum 1. That is, the toner adheres to that portion of the photosensitive drum in which charges have been attenuated by exposure (light portion and image portion).

At this time, the charging amount of the toner adhering onto the photosensitive drum 1 (the toner used for the development of the electrostatic images) is about −25 μC/g under an environment of a temperature 23° C. and an absolute moisture amount 10.5 g/m$^3$.

Also, the toner density of the dual-component developer in the developing device 4 is detected by an optical type toner density sensor (not shown). Then, in accordance with the detected information, a toner hopper 42 as toner supplying means is drive-controlled so that the toner density of the dual-component developer in the developing device 4 may be maintained within a substantially constant range. Thereby, the toner in the toner hopper 42 is supplied to the dual-component developer in the developing device 4.

Next, the toner image formed on the photosensitive drum 1 is primary-transferred to the intermediate transfer belt 11 by the primary transfer device 7. In the present embodiment, as the primary transfer device 7, use is made of a primary transfer roller which is a primary transfer member contacting with the inner peripheral surface of the intermediate transfer belt 11. The primary transfer roller 7 is brought into pressure contact with the photosensitive drum 1 with a predetermined pressure force. A transfer bias of a polarity (positive polarity) opposite to the regular charging polarity (negative polarity) of the toner is applied from a primary transfer bias voltage source (high voltage source) 103 as primary transfer bias output means to the primary transfer roller 7. In the present embodiment, a primary transfer bias of +2 kV is applied to the primary transfer roller 7. Thereby, the toner image on the photosensitive drum 1 is primary-transferred to the intermediate transfer belt 11.

Figure 3:
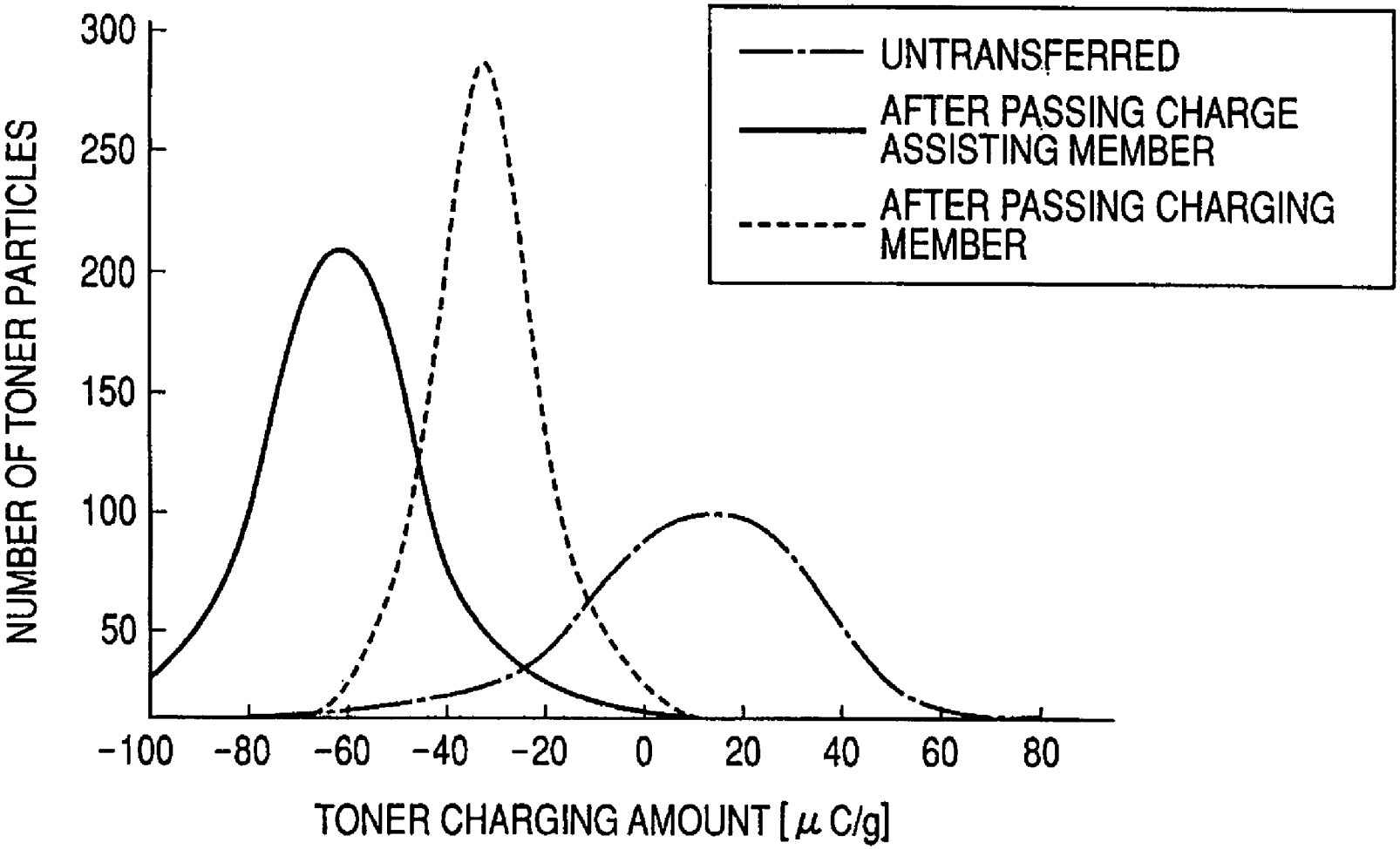
FIG. 3 is a graph showing an example of the charging amount distribution of an untransferred toner in an image forming apparatus of the cleanerless type.

The charging amount distribution of the primary-untransferred toner of the toner image on the photosensitive drum 1 which has not been primary-transferred to the intermediate transfer belt 11 is indicated by a dot-and-dash line in FIG. 3.

As described above, a transfer bias of the positive polarity is applied to the primary transfer roller 7. Therefore, it is often the case that the primary-untransferred toner has the positive polarity as the charging polarity, or has neither of the positive and negative polarities and is zero in charging amount [μC/g].

Next, the primary-untransferred toner is conveyed to the upstream charge assisting device 61 and the downstream charge assisting device 62, and the charging polarity of the toner is adjusted to a regular charging state. In the present embodiment, as the upstream charge assisting device 61 and the downstream charge assisting device 62 which are charge assisting means, use is made of charging brushes, which are brush-shaped charge assisting members. These charging brushes are disposed so as to contact with the surface of the photosensitive drum 1. However, the charge assisting members are not restricted to the fixed brush-shaped members, but may be members of any suitable shape such as brush-shaped rotary members, elastic rollers or sheet-shaped members.

First and second charge assisting bias voltage sources (high voltage sources) 104 and 105 as charge assisting bias output means are connected to the upstream charge assisting device 61 and the downstream charge assisting device 62, respectively. A DC voltage (in the present embodiment, +300 V) of a polarity (positive polarity) opposite to the regular charging polarity (negative polarity) of the toner is applied from the first charge assisting bias voltage source 104 to the upstream charge assisting device 61. Also, a DC voltage (in the present embodiment, −800 V) of the same polarity (negative polarity) as the regular charging polarity (negative polarity) of the toner is applied from the second charge assisting bias voltage source 105 to the downstream charge assisting device 62. By these two charge assisting devices 61 and 62, the charging polarity of the primary-untransferred toner is adjusted to the negative polarity, which is a regular charging state.

The charging amount distribution of the primary-untransferred toner after passing the upstream charge assisting device 61 and the downstream charge assisting device 62 is indicated by a solid line in FIG. 3.

Next, the primary-untransferred toner adjusted to the regular charging polarity is further adjusted in its charging amount by a vibration electric field comprising a DC voltage and an AC voltage superimposed one upon the other and applied to the charging roller 2. Thereby, the charging amount distribution of the toner becomes a narrow area distribution.

The charging amount distribution of the primary-untransferred toner after passing the charging roller 2 is indicated by a broken line in FIG. 3.

Then, the primary-untransferred toner thus adjusted in its charging amount is collected simultaneously with developing (cleaning simultaneous with developing) into the developing device 4 by fog removal potential (Vback) which is the potential difference between the dark potential (Vd) of the photosensitive drum 1 and a DC voltage (Vdc) applied to the developing sleeve 41. In the present embodiment, the fog removal potential is +150V.

In the present embodiment, four image forming portions of such a cleanerless type as described above are juxtaposed along the movement direction of the toner image bearing surface of the intermediate transfer belt 11. A color image is formed by these four image forming portions Pa, Pb, Pc and Pd.

(Re-transferred Toner)

Now, not only the primary-untransferred toners of the toner images formed by the respective image forming portions are conveyed to the upstream charge assisting device 61 and the downstream charge assisting device 62 of the second, third and fourth image forming portions Pb, Pc and Pd. In addition to this primary-untransferred toner, the re-transferred toner, which is part of the toner image formed by the more upstream image forming portion, is conveyed in the movement direction of the intermediate transfer belt 11.

The re-transfer is the phenomenon that part of the toner image transferred to the intermediate transfer belt in the upstream image forming portion with respect to the movement direction of the intermediate transfer belt 11 adheres onto the photosensitive drum 1 of the image forming portion downstream thereof when it passes through the primary transferring portion N1 of the downstream image forming portion. The re-transferred toner adheres onto the photosensitive drum 1 by the transfer electric field in the primary transferring portion N, and the mirroring force or the like with the photosensitive drum 1. For the more downstream image forming portion, the number of upstream image forming portions becomes greater. Therefore, in the more downstream image forming portion, the amount of re-transferred toner becomes greater. That is, typically, in the first, second, third and fourth image forming portions Pa, Pb, Pc and Pd, the amounts of re-transferred toners are in the relation that Pa<Pb<Pc<Pd.

Here, the primary-untransferred toner and the re-transferred toner are the toners which could not be borne on the intermediate transfer belt 11 even if a transfer electric field was applied in the primary transferring portion N1 of the image forming portion. Therefore, it is often the case that the primary-untransferred toner and the re-transferred toner are such that the charging changes thereof have a polarity opposite to the regular charging polarity or have no polarity. Also, it is often the case that the primary-untransferred toner and the re-transferred toner are abnormal-shaped toners as the toner shape or differ in the toner particle diameter from the mean particle diameter. Further, the re-transferred toner is part of a toner image composed of a toner of a discrete color formed in the upstream image forming portion and therefore, sometimes differs also in the nature of the toner.

The primary-untransferred toner and the re-transferred toner, as described above, are returned to their proper charging amounts by the upstream charge assisting device 61 and the downstream charge assisting device 62 provided downstream of the primary transferring portion N1 with respect to the rotation direction of the photosensitive member, and the charging roller 2, and are collected by the developing device 4. However, the more downstream image forming portions are greater in the amount of re-transferred toner and therefore, the upstream charge assisting device 61 and the downstream charge assisting device 62 are liable to be contaminated by the toners and an extraneous additive or the like accumulating thereon. Therefore, the more downstream image forming portions become the more insufficient in the control of the charging amounts of the primary-untransferred toner and the re-transferred toner.

Figure 4:
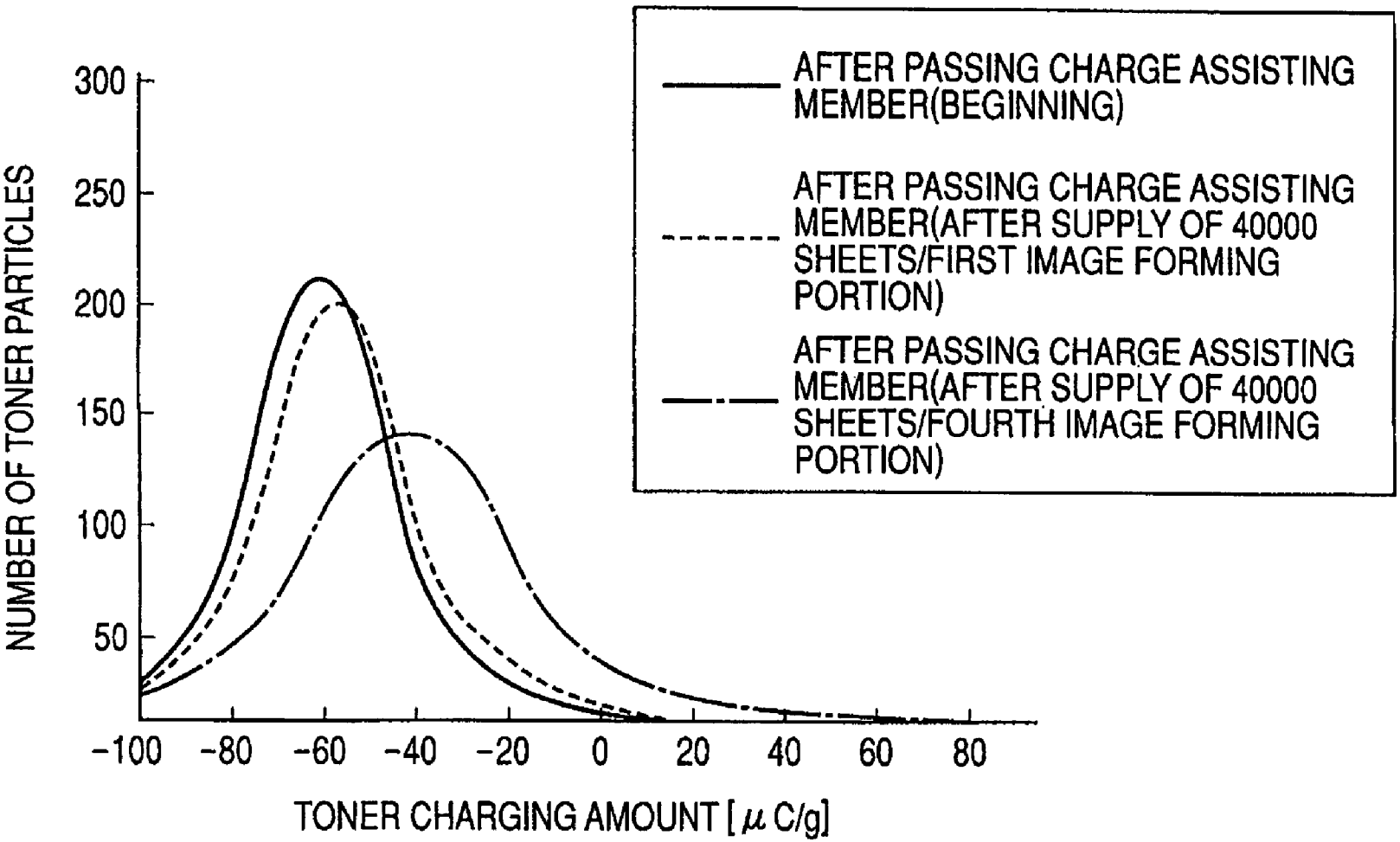
FIG. 4 is a graph showing an example of an endurance change in the charging amount distribution of the untransferred toner in the image forming apparatus of the cleanerless type.

FIG. 4 shows the charging amount distribution of the primary-untransferred toner after passing the upstream charge assisting device 61 and the downstream charge assisting device 62.

A solid line in FIG. 4 indicates the charging amount distribution in a state in which the number of image output sheets is still small and the contamination of the upstream charge assisting device 61 and the downstream charge assisting device 62 are slight.

Also, a broken line in FIG. 4 indicates the charging amount distribution of the primary-untransferred toner in the first image forming portion Pa when a solid image (image of the highest density level) has been outputted after 40,000 sheets of color images have been outputted. Here, the 40,000 sheets of color images had a mean image ratio of 5% with respect to each of yellow, magenta, cyan and black.

A dot-and-dash line in FIG. 4 indicates the charging amount distribution of the primary-untransferred toner in the fourth image forming portion Pd when a solid image (image of the highest density level) has been outputted after 40,000 sheets of color images have been outputted. Here, the 40,000 sheets of color images had a mean image ratio of 5% with respect to each of yellow, magenta, cyan and black.

In the fourth image forming portion Pd after a great deal of image formation has been repeated as described above, the charging amount adjusting capability for the toners by the upstream charge assisting device 61 and the downstream charge assisting device 62 is lowered. This can also be said about the second and third image forming portions Pb and Pc. Typically, the charging amount adjusting capability for the toners by the upstream charge assisting device 61 and the downstream charge assisting device 62 becomes lower in the more downstream image forming portions with respect to the movement direction of the intermediate transfer belt 11.

Therefore, it becomes often the case that the toners after passing the upstream charge assisting device 61 and the downstream charge assisting device 62 are not of the negative polarity which is the regular charging polarity, but are largely toners of the positive polarity or having neither of the positive and negative polarities and having an approximately zero charging amount [μC/g].

Such toners of the positive polarity and the toners having neither of the positive and negative polarities and having an approximately zero charging amount [μC/g] are not collected into the developing device 4 by the electric field by the fog removal potential (Vback) in the developing portion D. However, in a case where as in the present embodiment, the developing device 4 adopts the dual-component contact developing method, the toner on the photosensitive drum 1 is scraped off from the photosensitive drum 1 by the magnetic brush on the developing sleeve 41 in the developing portion D, and is collected into the developing device 4.

Accordingly, the charging amount distribution of the toner in the developing device 4 becomes a wide area distribution and the mean charging amount is reduced. Therefore, the toner adheres to the white background portion (non-image portion) on the photosensitive drum 1 forming the fog removal potential (Vback) between the drum 1 and the developing sleeve 41, and a faulty image such as "fog" becomes liable to occur.

Also, the re-transferred toner is part of a toner image comprising a toner of a discrete color formed in the upstream image forming portion. Therefore, the mixing of colors occurs in the developing device 4 into which the re-transferred toner has been collected, and an image of a proper color sometimes becomes incapable of being reproduced.

It is difficult for this phenomenon to occur during the image formation of a high mean image ratio when the consumption and supply of the toner are effected frequently. However, during the image formation of a low mean image ratio, the replacement of the toner is little and the stagnation time of the toner in the developing device 4 becomes long. Therefore, the transfer efficiency is lowered by the embedding or the like of the extraneous additive into the toner, and this phenomenon is liable to occur remarkably. The extraneous additive is extraneously added to the toner for the purposes of improving the charge imparting efficiency to the toner, and improving the transfer efficiency.

Accordingly, one of the objects of the present invention is to reduce the occurrence of a faulty image such as "fog" during the image formation of a low mean image ratio, and make the formation of an image of high quality possible. Also, another object of the present invention is to suppress the reduction in the color reproduction of an image-formed article by color mixture during the image formation of a low mean image ratio, and make the formation of an image of high quality possible.

(Toner Discharging Operation)

Description will now be made of the toner discharging operation (toner forcibly consuming operation), which is most characteristic in the present embodiment.

The image forming apparatus according to the present embodiment performs the "toner discharging operation (toner forcibly consuming operation)" of positively discharging the toner from the developing device 4 at predetermined timing except during the image forming operation in each of the first to fourth image forming portions Pa to Pd. Here, it is to be understood that the operation except during the image forming operation is a non-image forming operation. The predetermined timing except during image formation is set to the ante-rotation time, the post-rotation time, or between sheets. The ante-rotation time is a period for the preparatory operation of driving image forming elements including the photosensitive drum 1 before the image forming operation of forming an image to be transferred to the transfer material P and outputted. The post-rotation time is a period for the preparatory operation of driving the image forming elements including the photosensitive drum 1 after the image forming operation of forming the image to be transferred to the transfer material P and outputted. Between sheets is a period corresponding to the interval between the continuous transfer materials P during the continuous image forming operation to a plurality of transfer materials P.

Figure 5:
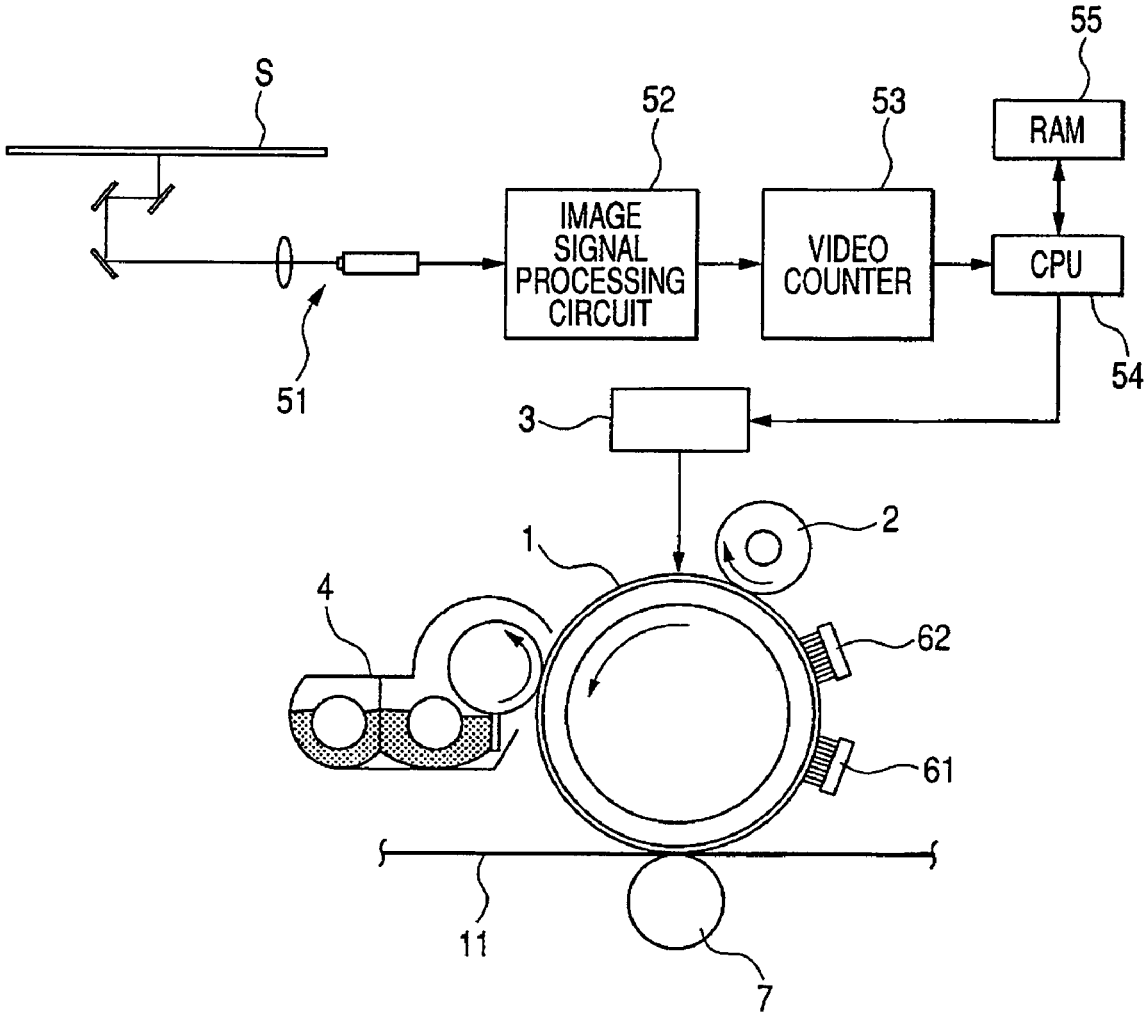
FIG. 5 is a block diagram showing the control system of the image forming apparatus of FIG. 1.

FIG. 5 shows a schematic control block diagram according to the present embodiment. As shown in FIG. 5, an original S to be copied is projected by a reader portion 51. The reader portion 51 resolves the image of the original into multiple pixel portions, and outputs an electrophotographic conversion signal corresponding to the density of each pixel. The output from the reader portion 51 is transmitted to an image signal processing circuit 52. This image signal processing circuit 52 forms a pixel image signal having an output level corresponding to the density of each pixel. At this time, the level of the output signal of the image signal processing circuit 52 is counted for each pixel, and is integrated by a video counter 53. The video count value V in which the level of the output signal for each pixel has been integrated corresponds to the toner amount consumed by the developing device 4 to form a sheet of image (toner image) of the original S. Also, this video count value V corresponds to the ratio (%) of the toner consumption amount, i.e., the image ratio (%), in actual image formation, to the toner consumption amount (known) when an image of a maximum density level is formed on the entire surface of an image forming area.

The video count value V is integrated and a video count integrated value V(n) is calculated each time a sheet of image formation is effected. Then, this integration signal, i.e., the video count integrated value V(n) is inputted to a CPU 54 as control means and also, is stored in a RAM 55 as storage means. The video count integrated value V(n) is obtained for each of the image forming portions Pa to Pd, and is stored in the RAM 55. The video count integrated values regarding the first, second, third and fourth image forming portions Pa, Pb, Pc and Pd are defined as V1(*n*), V2(*n*), V3(*n*) and V4(*n*), respectively. These video count integrated values V1(*n*) to V4(*n*) correspond to a value obtained by integrating the above-mentioned image ratio each time a sheet of image formation is effected (image ratio integrated value: %).

Figure 6:
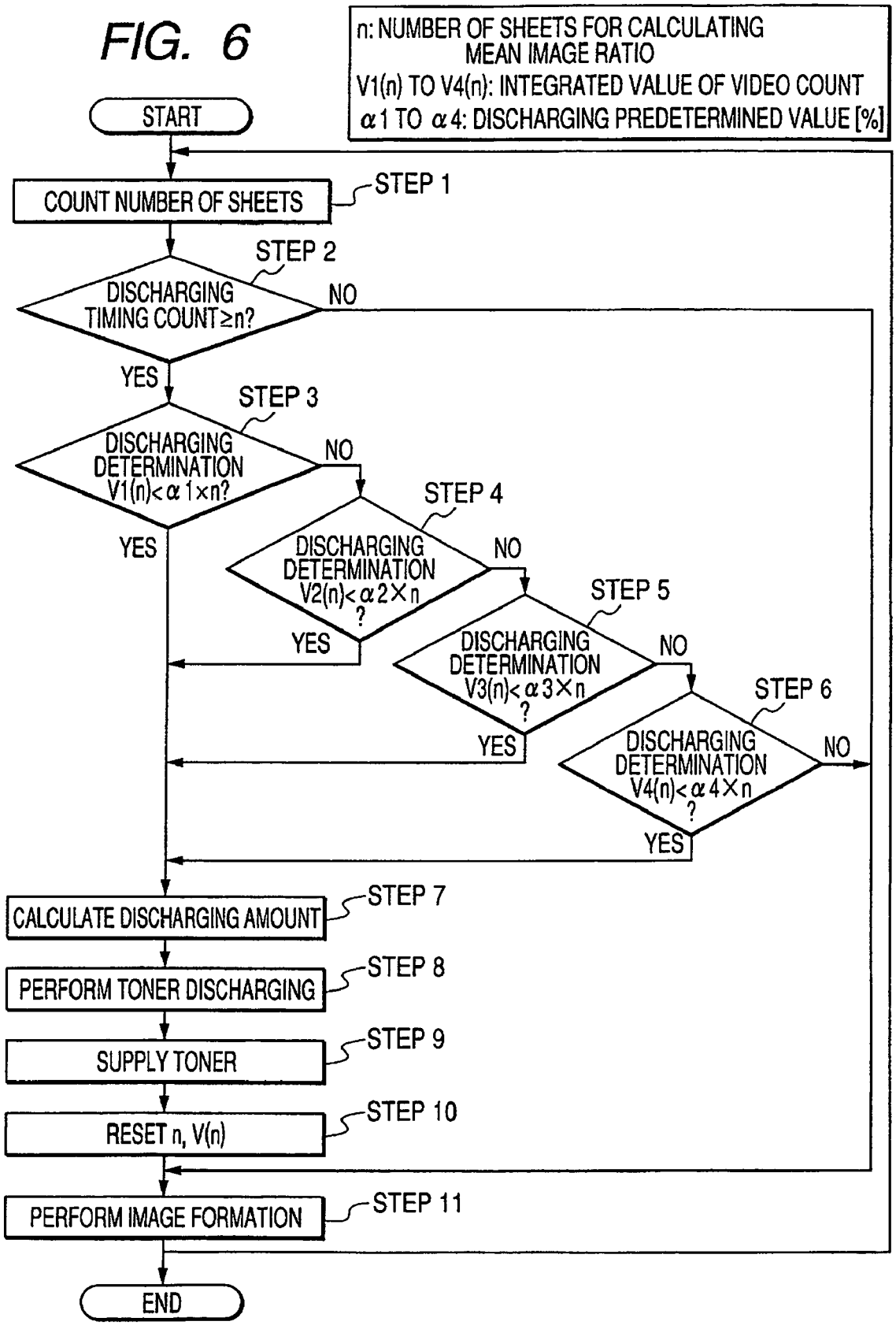
FIG. 6 is a flow chart showing an example of toner discharging control according to the present invention.

FIG. 6 is a flow chart of the control in the present embodiment. First, when the operation of the image forming apparatus 100 is started, the number of image-formed sheets from the last discharging timing is counted (step 1). In the present embodiment, the number of image-formed sheets is counted by the CPU 54 which functions as a counter. Then, the CPU 54, when this count value has become a predetermined number of sheets n (step 2), judges whether the toner discharging operation should be executed in the image forming portions Pa to Pd, on the basis of the video count integrated values V1(*n*) to V4(*n*), as follows.

The CPU 54 calculates a mean image ratio (%) converted per sheet of image, on the basis of the video count integrated values V1(*n*) to V4(*n*) stored for the respective image forming portions Pa to Pd, and the number of image-formed sheets n. Here, as described above, the video count integrated values V1(*n*) to V4(*n*) correspond to an image ratio integrated value (%) in a predetermined number n of image formation. Here, for the sake of convenience, the mean image ratios (%) about the image forming portions Pa to Pd are represented as V1(*n*)/n, V2(*n*)/n, V3(*n*)/n and V4(*n*)/n, respectively.

Then, the CPU 54 compares regarding the image forming portions Pa to Pd, the respective mean image ratio V1(*n*)/n, V2(*n*)/n, V3(*n*)/n and V4(*n*)/n with predetermined values $\alpha$1, $\alpha$2, $\alpha$3 and $\alpha$4, respectively. When the mean image ratios V1(*n*)/n, V2(*n*)/n, V3(*n*)/n and V4(*n*)/n are smaller than the predetermined values $\alpha$1, $\alpha$2, $\alpha$3 and $\alpha$4 (%), respectively, the CPU determines to execute the toner discharging operation (steps 3 to 6).

Then, the CPU 54 calculates the toner amount discharged from the developing device 4 to the photosensitive drum 1 so that about the image forming portions Pa to Pd, the mean image ratios may become equal to the corresponding predetermined values $\alpha$1 to $\alpha$4 (step 7). Then, the CPU 54 causes the toner discharging operation to be executed in accordance with the calculated discharged toner amount.

In the present embodiment, in the toner discharging operation, the photosensitive drum 1 is first charged by the charging roller 2 in the same way as in the ordinary image forming operation. Thereafter, an electrostatic image is formed on the photosensitive drum 1 by the exposing device 3 so that the mean image ratios may become equal to the predetermined values α1 to α4 with respect to the image forming portions Pa to Pd, respectively. Then, this electrostatic image is developed by the developing device 4, whereby the toner is discharged from the developing device 4 onto the photosensitive drum 1.

Here, in the present embodiment, the number of sheets n for calculating the mean image ratio is 200 sheets. Also, in the present embodiment, the predetermined values α1, α2, α3 and α4 are the same as the threshold values of the mean image ratios for determining whether the toner discharging operations in the first, second, third and fourth image forming portions Pa, Pb, Pc and Pd are executed. In the present embodiment, these predetermined values α1 to ≠4 were α1=2%, α2=2.5%, α3=3.5%, and α4=4%. That is, the predetermined values α1 to α4 were made greater for the more downstream image forming portions with respect to the movement direction of the intermediate transfer belt 11.

As an example, in the present embodiment, when the mean image ratios are less than the predetermined values α1 to α4, the differences between the mean image ratios corresponding to the image forming portions Pa to Pb at a point of time whereat the toner discharging operations are executed and the predetermined values α1 to α4 are calculated. Then, the exposing device 3 is controlled to discharge amounts of toners corresponding to the differences from the developing device 4 onto the photosensitive drum 1, to thereby form an electrostatic image on the photosensitive drum 1. For example, Table 1 below shows the discharged toner amounts (%) when the mean image ratios are 1(%), 2(%) and 3(%) with respect to the image forming portions Pa to Pd, and the ratios of the discharged toner amounts to the mean image ratios at that time.

TABLE 1

| | predetermined values (%) | | | | mean image |
|---|---|---|---|---|---|
| | α1 = 2 | α2 = 2.5 | α3 = 3.5 | α4 = 4 | ratio (%) |
| discharged toner amount (%) | 1 | 1.5 | 2.5 | 3 | 1 |
| discharged toner amount/mean image ratio | 1 | 1.5 | 2.5 | 3 | |
| discharged toner amount (%) | 0 | 0.5 | 1.5 | 2 | 2 |
| discharged toner amount/mean image ratio | — | 0.25 | 0.75 | 1 | |
| discharged toner amount (%) | 0 | 0 | 0.5 | 1 | 3 |
| discharged toner amount/mean image ratio | — | — | 0.17 | 0.33 | |

As described above, the image forming apparatus according to the present embodiment is provided with a plurality of image forming portions of the cleanerless type. The plurality of image forming portions include at least the following first and second image forming portions. That is, the first and second image forming portions perform the toner discharging operation of discharging the toner from the developing means at predetermined timing except during image formation. Also, the transferring portion for transferring the toner image to the transfer material in the second image forming portion is located downstream of the transferring portion for transferring the toner image to the transfer material in the first image forming portion with respect to the movement direction of the transfer material. The amount of toner discharged from the developing means in the toner discharging operation is greater in the second image forming portion than in the first image forming portion. Particularly, in the present embodiment, the first image forming portion and the second image forming portion perform the toner discharging operations of discharging the toners from respective developing means in accordance with the image ratios of images formed by the image forming operations in respective image forming portions. The amount of toner discharged from the developing means in the toner discharging operation with respect to the image ratio is greater in the second image forming portion than in the first image forming portion.

The discharged toner amount can be increased by increasing the density of a toner image formed on the image bearing member in the toner discharging operation, or lengthening the formation time of the toner image (making the area of the toner image large).

Typically, as in the present embodiment, the discharged toner amount with respect to the image ratio is made greater in the more downstream image forming portions with respect to the movement direction of the transfer material, from the most upstream image forming portion to the most downstream image forming portion with respect to the movement direction of the transfer material.

Thereby, even when an image of a low mean image ratio is to be formed, it is possible to reduce the occurrence of a faulty image such as "fogged image" caused in the more downstream image forming portions due to a widened distribution of the charging amount of the toner by the toner not having a proper charging amount being mixed into the toner in the developing means. Also, in a case where the developing means of the plurality of image forming portions are filled with toners of colors differing in spectroscopic characterization from one another, it is possible to reduce the reduction in the color reproduction of an image-formed article due to color mixture even when an image of a low mean image ratio is to be formed.

In the present embodiment, in the manner described above, the toner discharged from the developing device 4 is primary-transferred onto the intermediate transfer belt 11. On the other hand, a voltage of a polarity (negative polarity) opposite to the secondary transfer bias is applied to the secondary transfer device 12, whereby the toners on the intermediate transfer belt 11 are not secondary-transferred to the secondary transfer device 12 side, but pass through the secondary transferring portion N2. Thereafter, the toners on the intermediate transfer belt 11 are collected by the belt cleaning device 13.

Also, the developing device 4 discharges the toner, whereby the toner density in the developing device 4 is lowered, but an amount of toner corresponding to the discharged amount is supplied from the toner hopper 42 (step 9).

When the toner discharging operation as described above is terminated, the counter is reset (step 10), and the ordinary image forming operation is performed (step 11).

Figure 7:
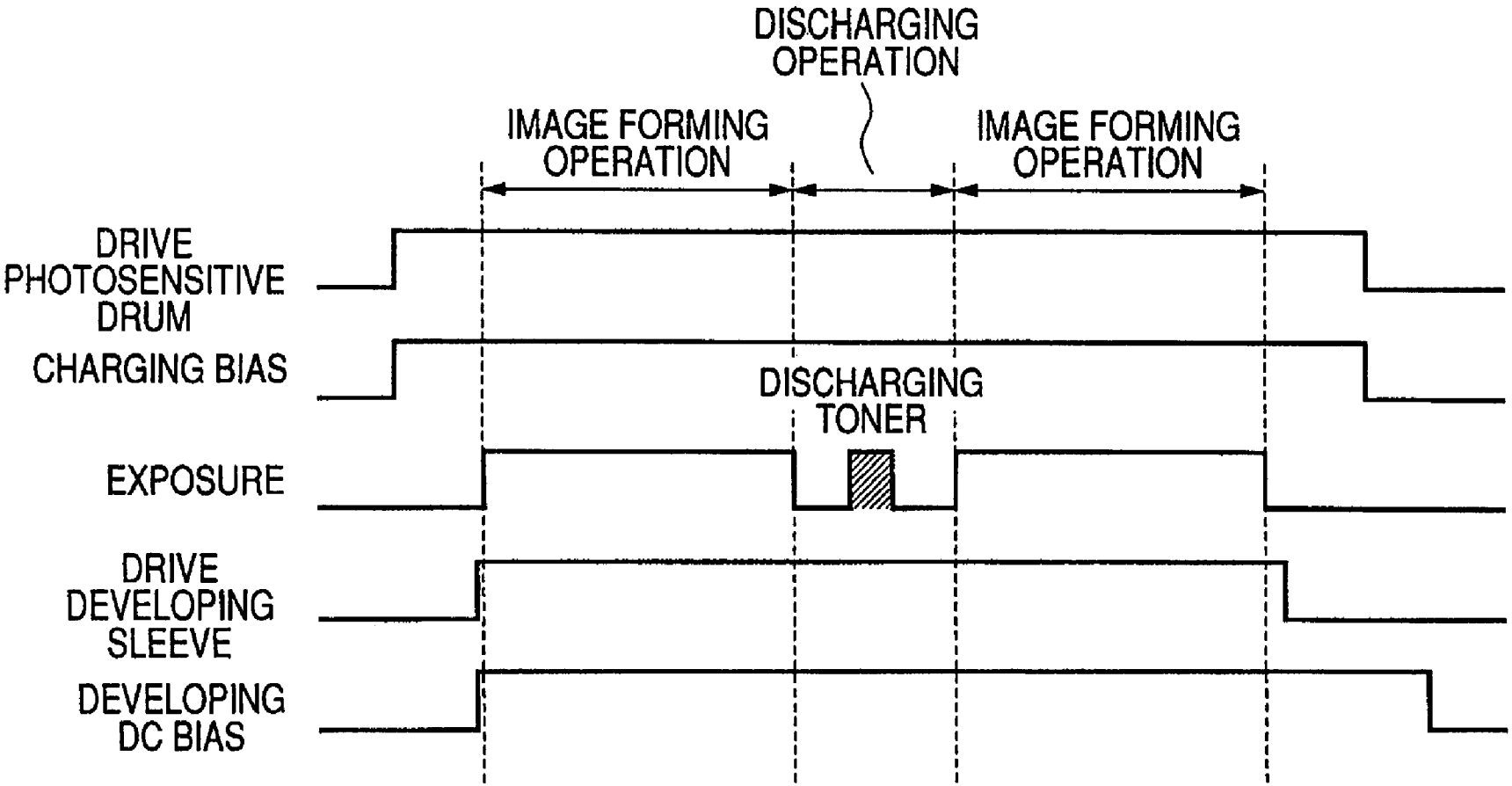
FIG. 7 is a timing chart showing the operation timing of charging means, exposing means and developing means in an example of a toner discharging operation according to the present invention.

FIG. 7 shows a timing chart of the charging, exposing and developing operations when the toner discharging operation has been performed during a continuous image forming operation. When during the continuous image forming operation, the counter reaches a predetermined number of sheets, the toner discharging amount is determined by the above-described flow shown in FIG. 6. Then, the image forming operation is interrupted, and between the sheets, an electrostatic image for discharging the toner is formed on the photosensitive drum 1 by the exposing device 3. At this time, a charging bias is applied to the charging roller 2 and a developing bias is applied to the developing sleeve 41 and therefore, a toner image is formed on the photosensitive drum 1, and the discharging of the toner from the developing device 4 to the photosensitive drum 1 is effected.

In the above-described toner discharging operation, the charging process of the photosensitive drum 1 by the charging roller 2 and the exposure of the photosensitive drum 1 by the exposing device 3 have been carried out in order to form an electrostatic image for toner discharging on the photosensitive drum 1. In contrast, without the exposure by the exposing device 3 being effected, the toner can also be discharged from the developing device 4 onto the photosensitive drum 1.

Figure 8:
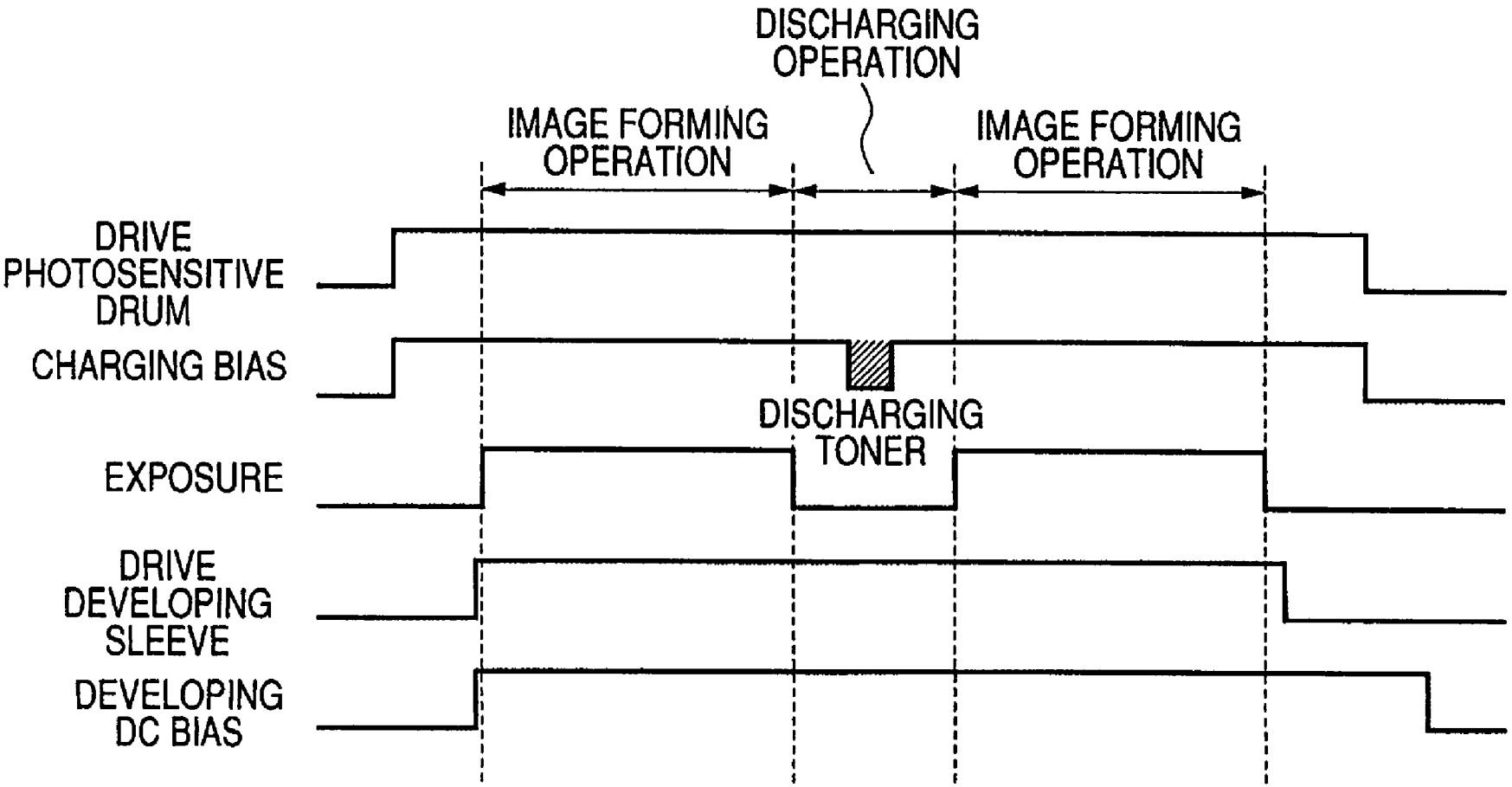
FIG. 8 is a timing chart showing the operation timing of charging means, exposing means and developing means in another example of the toner discharging operation according to the present invention.

FIG. 8 is a timing chart in a case where the formation of the electrostatic image for discharging the toner is effected not by exposure, but by the potential difference between the charging potential and the developing potential. That is, the exposure of the photosensitive drum 1 by the exposing device 3 is not effected at the timing whereat the toner discharging operation is performed. Instead, the charging bias applied to the charging roller 2 is reduced or stopped to thereby form the electrostatic image for toner discharging. By the potential difference between the photosensitive drum 1 corresponding to the portion in which the charging bias has been stopped and the developing sleeve 41 to which the developing bias is being applied, the toner is discharged from the developing device 4 to the photosensitive drum 1. Thus, even if the method of forming the electrostatic image for toner discharging differs, if the discharged amount of the toner is equal, there will be obtained an effect similar to that described above.

Also, it has been to be understood that the above-described toner discharging operation is performed between the sheets. However, a similar toner discharging operation may be performed during the ante-rotation or the post-rotation of the image forming operation. Also, such a toner discharging operation need not be performed at a time in all the image forming portions Pa to Pd, but may be performed at different timing in each of the image forming portions Pa to Pd.

As described above, in the present embodiment, the image forming apparatus 100 is provided with a plurality of image forming portions of the cleanerless type. When image formation of a low mean image ratio has been much effected, it effects the control of making the discharged toner amount more in the downstream image forming portions with respect to the movement direction of the intermediate transfer belt 11. By effecting such control, a faulty image such as the fog of the white background portion did not occur even if the image formation of an image of a high image ratio to an image of a low image ratio was effected throughout the long-term use of the image forming apparatus 100. Nor did occur a faulty image such as faulty color reproduction, which is caused by the color mixture due to the re-transfer of a toner image comprising a toner of a discrete color formed by the upstream image forming portion in the downstream image forming portions.

Also, in the present embodiment, $\alpha 1$=2%, $\alpha 2$=2.5%, $\alpha 3$=3.5%, and $\alpha 4$=4%. In contrast, even when the predetermined values $\alpha 1$ to $\alpha 4$ were changed to $\alpha 1$=2%, $\alpha 2$=2%, $\alpha 3$=3.5%, and $\alpha 4$=4%, the faulty image (fog or faulty color reproduction due to re-transfer) by the toner collected by the developing device 4 did not occur. This is considered to be partly because the color mixture of the yellow toner from the first image forming portion Pa and the magenta toner in the second image forming portion Pb is hardly conspicuous. Again in this case, in the first, third and fourth image forming portions Pa, Pc and Pd or the second, third and fourth image forming portions Pb, Pc and Pd, the discharged toner amount relative to the image ratio is greater on the downstream side. Therefore, the occurrence of the faulty image (fog or faulty color reproduction due to re-transfer) by the toner collected by the developing device 4 can be suppressed to a degree practically free of any problem as a whole.

As described above, according to the present embodiment, even if the image formation of an image of a high image ratio to an image of a low image ratio is effected throughout the long-term use of the image forming apparatus 100, it is possible to prevent a faulty image resulting from the collection of the primary-untransferred toner and the re-transferred toner to the developing device 4. That is, according to the present embodiment, it is possible to reduce an inconvenience due to the toner from the more upstream image forming portions with respect to the movement direction of the transfer material being collected by the developing means of the more downstream image forming portions.

Embodiment 2

Another embodiment of the present invention will now be described. The basic construction and operation of an image forming apparatus according to the present embodiment are the same as those of Embodiment 1. Accordingly, elements identical or corresponding in function and construction with or to those in Embodiment 1 are given the same reference characters and need not be described in detail, and the characteristic points of the present embodiment will hereinafter be described.

In Embodiment 1, with regard to the plurality of image forming portions Pa to Pd, in the more downstream image forming portions with respect to the movement direction of the intermediate transfer belt 11, the discharged toner amount has been made greater relative to the image ratio. In contrast, in the present embodiment, with regard to the other image forming portions than the image forming portion Pd provided with the developing device 4 filled with the black toner, in the more downstream image forming portions with respect to the movement direction of the intermediate transfer belt 11, the discharged toner amount is made greater relative to the image ratio.

The flow chart of the control in the present embodiment is the same as that of Embodiment 1 shown in FIG. 6. In the present embodiment, however, the predetermined values $\alpha 1$ to $\alpha 4$ are $\alpha 1$=2%, $\alpha 2$=2.5%, $\alpha 3$=3.5%, and $\alpha 4$=3%. That is, regarding the most downstream fourth image forming portion Pd with respect to the movement direction of the intermediate transfer belt 11, the predetermined value $\alpha 4$ is made smaller than the predetermined value $\alpha 3$ regarding the adjacent upstream third image forming portion Pc.

Further describing, the toner filling the fourth image forming portion Pd is black. Therefore, it is difficult for the faulty color reproduction caused by the color mixture due to some of the toner images formed by the more upstream first, second and third image forming portions Pa, Pb and Pc being re-transferred in the primary transferring portion N1 of the fourth image forming portion Pd to occur.

Also in this case, regarding the first to third image forming portions Pa to Pc except the fourth image forming portion Pd, the discharged toner amount relative to the image ratio is greater on the more downstream side with respect to the movement direction of the intermediate transfer belt 11. In the present embodiment, the predetermined value $\alpha 4$ regarding the fourth image forming portion Pd is greater than the predetermined values $\alpha 1$ and $\alpha 2$ regarding the first and second image forming portions Pa and Pb, respectively. Therefore, it is possible to reduce the occurrence of the faulty image (fog or the faulty color reproduction due to re-transfer) by the toner collected by the developing device 4, to a degree practically free of any problem as a whole.

Further, in the present embodiment, the discharged toner amount in the fourth image forming portion Pd is small and therefore, the amount of waste toners collected by the belt cleaning device 13 can be reduced by the toner discharging operation.

As described above, in the present embodiment, the image forming apparatus 100 is provided with a plurality of image forming portions of the cleanerless type. When the image formation of a low mean image ratio has been much effected, the control of making the discharged toner amount more in the more downstream image forming portions with respect to the movement direction of the intermediate transfer belt 11, except the fourth image forming portion Pd provided with the developing device 4 filled with the black developer is effected. By effecting such control, even if the image formation of an image of a high image ratio to an image of a low image ratio was effected throughout the long-term use of the image forming apparatus 100, a faulty image such as the fog of the white background portion did not occur. Nor did occur a faulty image such as faulty color reproduction, which is caused by the color mixture due to the re-transfer of a toner image comprising a toner of a discrete color formed by the upstream image forming portion in the downstream image forming portions.

Also, in the present embodiment, $\alpha 1$=2%, $\alpha 2$=2.5%, $\alpha 3$=3.5%, and $\alpha 4$=3%. In contrast, even when the predetermined values $\alpha 1$ to $\alpha 4$ has been changed to $\alpha 1$=2%, $\alpha 2$=2%, $\alpha 3$=3.5%, and $\alpha 4$=3%, the faulty image (fog or the faulty color reproduction due to re-transfer) by the toner collected by the developing device 4 has not occurred. This is considered to be for a reason similar to that set forth in Embodiment 1.

As described above, according to the present embodiment, even if the image formation of an image of a high image ratio to an image of a low image ratio is effected throughout the long-term use of the image forming apparatus 100, it is possible to prevent a faulty image resulting from the collection of the primary-untransferred toner and the re-transferred toner to the developing device 4. That is, according to the present embodiment, it is possible to reduce the inconvenience due to the toner from the more upstream image forming portion with respect to the movement direction of the transfer material being collected by the developing means of the more downstream image forming portion. Further, it is possible to reduce the amount of waste toners collected in the toner discharging operation.

Embodiment 3

Still another embodiment of the present invention will now be described. It is to be understood that the basic apparatus construction of the present embodiment is similar to that of the previous embodiment.

In the previous embodiment, design has been made such that the toner discharging operation is performed at the same timing (for a predetermined number of image-formed sheets) in any image forming portions. In contrast, in the present embodiment, this timing is changed in each image forming portion. That is, in the more downstream image forming portions, this predetermined number of image-formed sheets is made smaller and the frequency of the toner discharging operation is made higher. However, the black image forming portion is not restricted thereto.

For example, it is to be understood that this predetermined number of image-formed sheets is 200 sheets for the first image forming portion Pa, 180 sheets for the second image forming portion Pb, 160 sheets for the third image forming portion Pc, and 200 sheets for the fourth image forming portion Pd. It is to be understood that the discharging amount per one cycle of toner discharging is the same in any image forming portions.

By adopting such a construction, the frequency of toner discharging becomes higher in the more downstream image forming portions and therefore, the toner discharging amount can be made greater.

Again by the present embodiment, as in the above-described Embodiments 1 and 2, it is possible to reduce the inconvenience due to the toner from the more upstream image forming portion with respect to the movement direction of the transfer material being collected by the developing means of the more downstream image forming portion.

While the present invention has been described above with respect to the specific embodiments thereof, the present invention is not restricted to the above-described embodiments.

Figure 9:
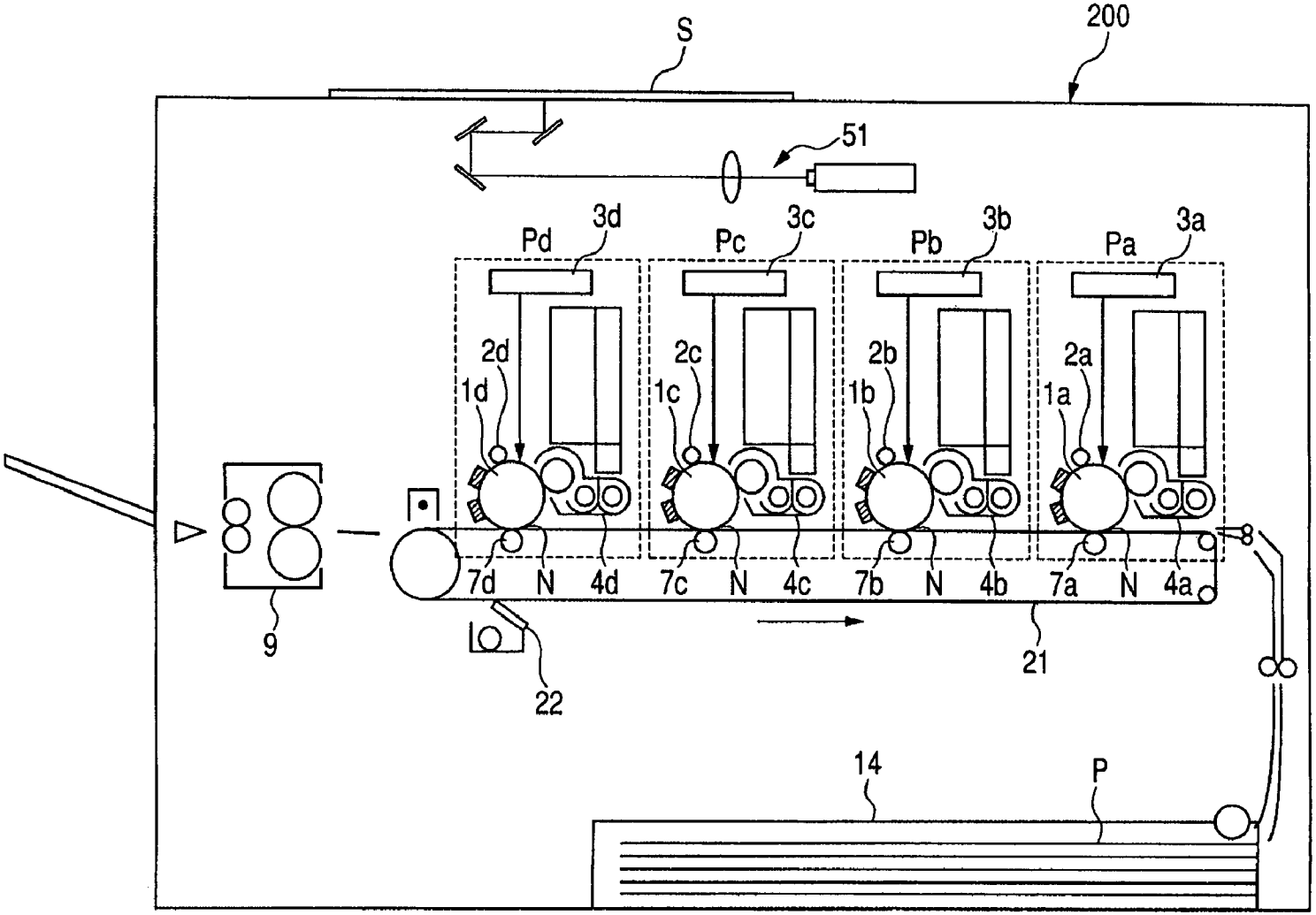
FIG. 9 is a schematic cross-sectional view of another embodiment of the image forming apparatus according to the present invention.

For example, in each of the foregoing embodiments, the image forming apparatus has been described as an image forming apparatus of the intermediate transfer type provided with an intermediate transfer belt, whereas the present invention is not restricted thereto. The present invention is equally applicable to an image forming apparatus of a direct transfer type, and can obtain an effect similar to that of each of the above-described embodiments. FIG. 9 shows a schematic cross-sectional view of an image forming apparatus 200 of the direct transfer type as another example of the image forming apparatus to which the present invention is applicable. In FIG. 9, elements identical or corresponding in function and construction with or to those of the image forming apparatus shown in FIG. 1 are given the same reference characters. The image forming apparatus 200 shown in FIG. 9 has a conveying belt 21 as a transfer material bearing member for bearing and conveying a transfer material P thereon. A toner image formed on a photosensitive drum 1 in each of image forming portions Pa to Pd is transferred to the transfer material P borne on the conveying belt 21 by a transfer device 7 as transferring means. Again in such an image forming apparatus 200, as in the above-described embodiments, the toner discharging operation can be performed at predetermined timing. The toner discharged onto the photosensitive drum 1 in the toner discharging operation is transferred onto the conveying belt 21, and is collected by a belt cleaning device 22.

Also, in each of the above-described embodiments, the image forming apparatus has been described as having charge assisting means in each image forming portion. The present invention, however, is not restricted thereto, but is equally applicable to an image forming apparatus not provided with the charge assisting means, and can obtain an effect similar to that of each of the above-described embodiments. For example, the untransferred toner or the re-transferred toner is uniformized by a brush-shaped member or the like, and thereafter is once collected into charging means (contact charging means such as, for example, a magnetic brush charger). Then, the toner is charged to a regular polarity by the charging means to which a charging bias is applied, and this toner is returned from the charging means onto the image bearing member. This toner is collected simultaneously with developing by developing means.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2005-250260, filed Aug. 30, 2005 which is hereby incorporated by reference herein in its entirety.

What is claimed is:

1. An image forming apparatus comprising:

a plurality of image forming stations each including an image bearing member on which an electrostatic image is formed, a developing device, which collects a untransferred toner on said image bearing member and at the same time, developing the electrostatic image with a toner, and a transfer device, which transfers the toner image on said image bearing member to a transfer material, said plurality of image forming stations being disposed along a movement direction of the transfer material, and control means for controlling in such a manner that, when during a non-image forming operation, a toner discharging operation of discharging the toner from each of said developing devices to each of said image bearing member is performed in a first station and a second station downstream of said first station with respect to the movement direction of said transfer material, of said plurality of image forming stations, a toner discharging amount in said second station is greater than a toner discharging amount in said first station.

2. An image forming apparatus according to claim 1, wherein said control means performs a control of the toner discharging operation in each image forming station in accordance with the image ratio of the image formed by each image forming operation in said first station and said second station, and wherein the toner discharging amount with respect to the image ratio is greater in said second station than in said first station.

3. An image forming apparatus according to claim 2, wherein said control means controls in such a manner that, when the toner discharging operation is performed in said plurality of image forming stations, the toner discharging amount is greater in a more downstream image forming station with respect to the movement direction of the transfer material.

4. An image forming apparatus according to claim 2, wherein one of said plurality of image forming stations is a black image forming station, which performs image formation by a black toner, and wherein said control means controls in such a manner that, when the toner discharging operation is performed in the other stations of said plurality of image forming stations than said black image forming station, the toner discharging amount is greater in a more downstream image forming station with respect to the movement direction of the transfer material.

5. An image forming apparatus according to claim 1, wherein said control means performs the toner discharging operation when a ratio of the image formed by each image forming operation in each of said plurality of image forming stations is smaller than a predetermined value determined for each of said plurality of image forming stations.

6. An image forming apparatus according to claim 1, wherein said control means performs each of the toner discharging operations in said first station and said second station with a predetermined frequency, and wherein the predetermined frequency of the toner discharging operation in said second station is higher than the predetermined frequency of the toner discharging operation in said first station.

7. An image forming apparatus according to claim 1, wherein each of said developing devices uses a developer including a toner and a carrier.

* * * * *

UNITED STATES PATENT AND TRADEMARK OFFICE

CERTIFICATE OF CORRECTION

PATENT NO. : 7,418,223 B2
APPLICATION NO. : 11/509026
DATED : August 26, 2008
INVENTOR(S) : Shinya Suzuki It is certified that error appears in the above-identified patent and that said Letters Patent is hereby corrected as shown below:

COLUMN 1:
Line 62, “uedly” should read --uously--.

COLUMN 13:
Line 12, “≠4” should read --α4--.

COLUMN 15:
Line 31, “been” should be deleted.

COLUMN 18:
Line 67, “exemplary” should read --the exemplary--.

COLUMN 19:
Line 12, “a” (second occurrence) should be deleted.
Line 14, “developing” should read --develops--.
Line 33, “the” (first occurrence) should read --an--.

Signed and Sealed this

Seventeenth Day of February, 2009

John Doll

JOHN DOLL
*Acting Director of the United States Patent and Trademark Office*